United States Patent [19]

Van Deusen et al.

[11] 4,293,983

[45] Oct. 13, 1981

[54] HIGH SPEED GILL BOX

[75] Inventors: George S. Van Deusen; Joseph F. Ogrinc, both of Gastonia, N.C.

[73] Assignee: The Warner & Swasey Company, Cleveland, Ohio

[21] Appl. No.: 77,079

[22] Filed: Sep. 19, 1979

[51] Int. Cl.[3] ..... D01G 19/10

[52] U.S. Cl. ..... 19/127; 19/129 R

[58] Field of Search ..... 19/115 R, 126, 127, 19/129 R, 236

[56] References Cited

U.S. PATENT DOCUMENTS

| | | | |
|---|---|---|---|
| 717,380 | 12/1902 | Fraser et al. | 19/115 R |
| 2,596,764 | 5/1952 | Dotti | 19/127 |
| 2,666,958 | 1/1954 | Dotti | 19/127 |
| 2,740,996 | 4/1956 | Dudley et al. | 19/236 |
| 2,946,097 | 7/1960 | Hoppner et al. | 19/127 |
| 3,984,897 | 10/1976 | Takao | 19/129 R |
| 4,107,821 | 8/1978 | Herubel | 19/127 |

FOREIGN PATENT DOCUMENTS

| | | | |
|---|---|---|---|
| 740425 | 11/1955 | United Kingdom | 19/127 |

*Primary Examiner*—Louis Rimrodt
*Attorney, Agent, or Firm*—Howard G. Massung

[57] ABSTRACT

A high speed gill box having an upper head and lower head each of which contains a compliment of individual unconnected faller bars constrained to move in a smooth closed loop path. Each head is constructed to engage the associated faller bars outside of the pinned area to guide the faller bars through the closed loop path. Cam tracks are provided outside of the faller bar guide paths for engaging a crank arm extending away from the main pinned portion of each faller bar to provide proper orientation as the faller bar moves along its fixed path. Sprocket drives are provided in each head for engaging some of the faller bars and pushing them along the closed loop path. The pushed faller bars, as they exit the drive sprockets, push the faller bars ahead of them through the closed loop path. The drive sprockets are mounted at one end of the drafting zone while idler sprockets are mounted at the other end of the drafting zone to facilitate movement of the faller bars from the drafting zone. A driven crowder roll is provided ahead of where the faller bars are engaged by the drive sprockets to engage and crowd the bars together before they reach the drive sprockets. Crowding of the faller bars assures that each bar enters the drive sprocket smoothly. Since there may be a small separation between the faller bars at some point in the closed loop path, the crowder roll is necessary to assure high speed operation.

11 Claims, 13 Drawing Figures

HIGH SPEED GILL BOX

BACKGROUND OF THE INVENTION

1. Field of the Invention

This invention relates to apparatus for conditioning textile sliver and more particularly to a high speed gill box wherein individual faller bars are forced around a closed loop path.

2. Description of the Prior Art

Gill boxes for combing textile sliver are well known in the art. In one type of known gilling machine the faller bars are advanced by a pair of upper and lower screws. Chain gills in which the faller bars are carried through their fixed paths by complex chains rather than by feed and return screws have been manufactured in Europe for many years.

In these known gilling machines when the velocity of movement of the gill bars is low the faller bars can move smoothly without difficulty. However, when the velocity or rate of advance of movement of the faller bars is increased it becomes difficult with a screw type machine to transfer the faller bars from the forward moving faller bar screws to the backward moving faller bar screws and vice versa. The S-cam and knocker cam operation in some prior art machines limits operating speed. Furthermore, in these known types of gilling machines a relatively high noise level is generated in proportion to an increase in velocity. Thus, the high speed operation of the prior art gilling machine is impeded and it is difficult to maintain high speed gill box operation compatible with the high speed operation of the associated textile machinery.

SUMMARY OF THE INVENTION

In a gill box according to the present invention an upper and lower head are provided each of which contains a plurality of individual unconnected faller bars constrained to move in a smooth closed loop path. During operation the upper head and the lower head are joined together to define a drafting zone through which the textile sliver travels. The path in the upper head is a mirror image of the path in the lower head. The two paths approach and move essentially parallel to each other for a fixed distance to form a drafting zone through which textile sliver passes. The upper and lower faller bars are relatively offset so that the pins from the faller bars on one head are disposed intermediate pins of a pair of adjacent faller bars on the opposite head while passing through the drafting zone. The faller bars are essentially of an elongated cylindrical shape and the sum of the diameters of all the bars approximately equals the length of the closed loop path. Thus, each faller bar is in contact with the faller bar ahead of it and any motion imparted to one bar results in motion to the other bars. A pair of drive sprockets are provided on each head, at the beinning of the drafting zone, to engage a fixed number of faller bars in each path. Rotation of these drive sprockets results in movement of the faller bars through their path. The sprocket shafts for the upper and lower heads are interconnected for simultaneous movement. A pair of idler sprockets are provided at each end of the drafting zone for each head to facilitate faller bar movement out of the drafting zone.

The construction of each head provides that the sum of all the faller bars contacting diameters in the closed loop path of each head will be slightly shorter than the length of the path. Hence, a small gap will develop between some bars in the path. If this gap occurs at the point where the faller bars enter the drive sprockets a jam can result. A crowder roll is mounted inside the closed loop path to engage the faller bars and crowd the bars together before they are engaged by the drive sprocket. The crowder roll thus assures that each faller bar enters the drive sprocket smoothly.

A cam track arrangement is provided to maintain the faller bar pins perpendicular to the sliver in the drafting zone and to control the orientation of the pins at all points along the bar path. A pair of cam tracks are provided on each head outside of the faller bar guide path. These cam tracks engage crank arms which extend from the ends of the faller bars to maintain the desired faller bar orientation. The crank arm extends from the opposite ends of adjacent faller bars disposed in the closed path. Sliver entering the drafting zone is penetrated by the faller bar pins which sieze and carry the stock through the drafting zone and expel it at the opposite end where it is grasped by a set of nip rolls. Thus, drafting of the textile sliver is accomplished in the same manner as with conventional gill boxes.

Each faller bar is provided with a pair of hardened journals which slide in and support the faller bar from the guide path. The hardened journals are engaged by the drive sprockets during operation. The drive sprockets, although interconnected, preferably by gearing for synchronous movement, are offset angularly one half tooth so that the pins on one head extend intermediate the pins on a pair of adjacent faller bars on the opposite head while in the drafting zone. The upper head and the lower head are provided with timing gears which can engage, as the upper head and lower head are secured together, to assure the proper angular offset of the upper and lower drive sprockets The path in the upper and lower heads which the faller bars follow is smooth, without discontinuities, and this permits higher surface speeds than are attainable with conventional gill box drafters. The disclosed machine is also capable of higher production rates at a much lower noise level than those attainable with conventional gill box drafters, while retaining the sliver control advantages that the gill box drafters offer over other drawing methods.

It is an object of this invention to teach a gill box drafter capable of operating at higher production rates and at a lower noise level than those attainable with prior art gill boxes.

It is a further object of this invention to teach a gill box drafter having a pair of heads wherein each head utilizes a plurality of unconnected faller bars disposed in a closed loop path wherein a suitable drive means engages and pushes some of the faller bars to move all faller bars along the closed loop path.

BRIEF DESCRIPTION OF THE DRAWINGS

For a better understanding of the invention, reference may be had to the preferred embodiment, exemplary thereof, illustrated in the accompanying drawings wherein.

DESCRIPTION OF THE PREFERRED EMBODIMENT

Figure 7:
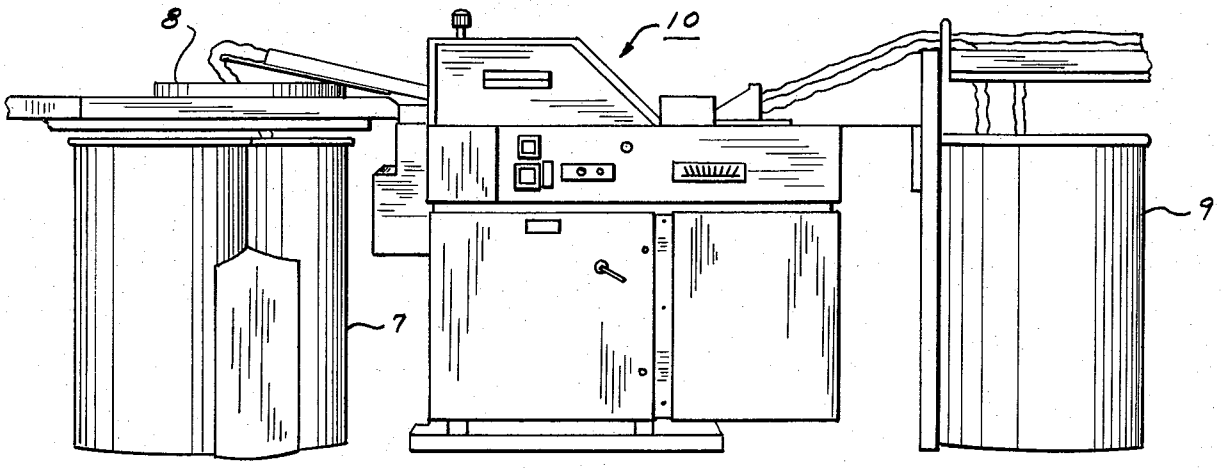
FIG. 7 is a side view of an installed gill box.
Figure 8:
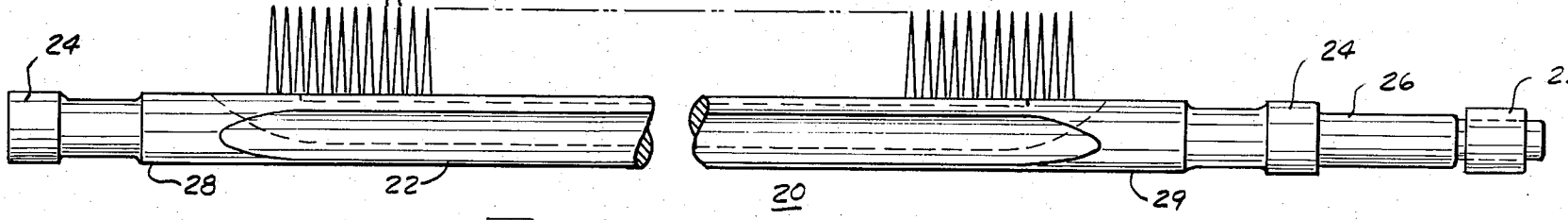
FIG. 8 is a view of a faller bar utilized with the apparatus of the present invention.
Figure 9:
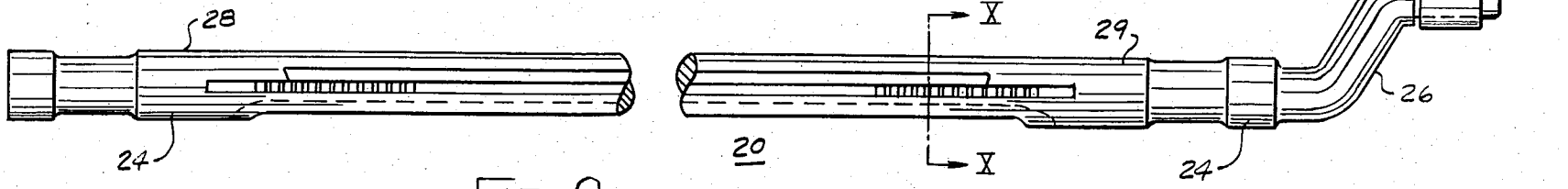
FIG. 9 is a top view of the faller bar of FIG. 8.
Figure 11:
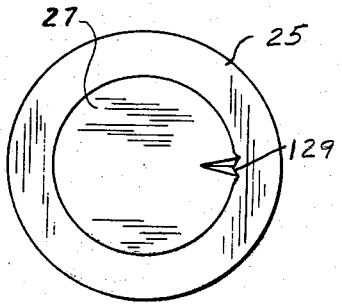
FIG. 11 is an enlarged right end view of the faller bar shown in FIG. 8.
Figure 10:
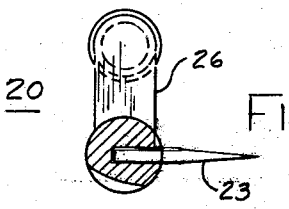
FIG. 10 is a section view in FIG. 9 taken along the line X—X.

Referring to FIG. 7, there is shown a gill box 10 for drafting sliver from cans 9. Gill box 10 feeds the drafted sliver to planetary coiler 8. Planetary coiler 8 packs the sliver in cans 7.

Figure 1:
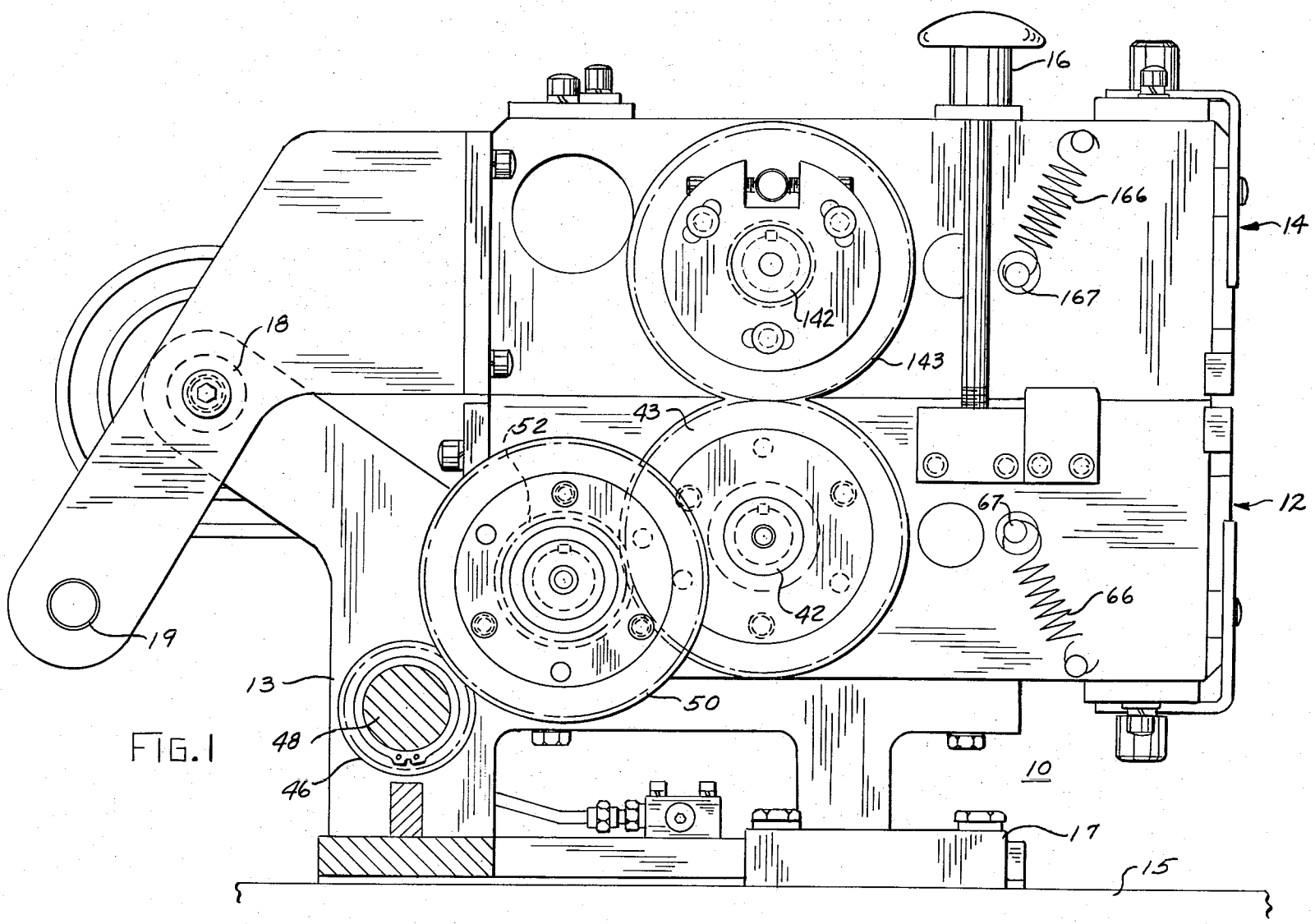
FIG. 1 is a side view of a gill box drafter according to the teaching of the present invention.
Figure 2:
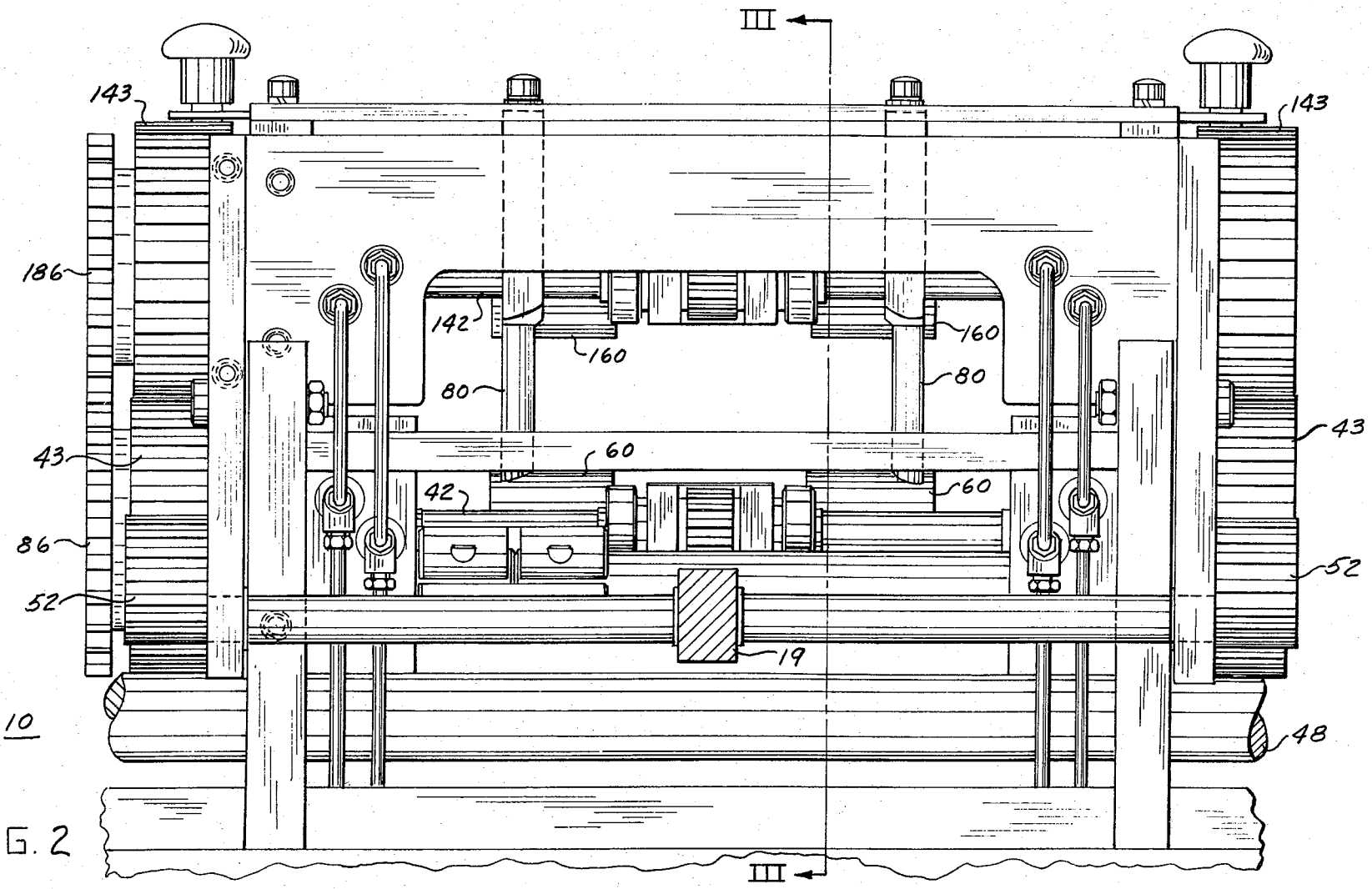
FIG. 2 is a view of the gill box shown in FIG. 1 (with the faller bar omitted for clarity) from the end which the sliver enters.
Figure 3:
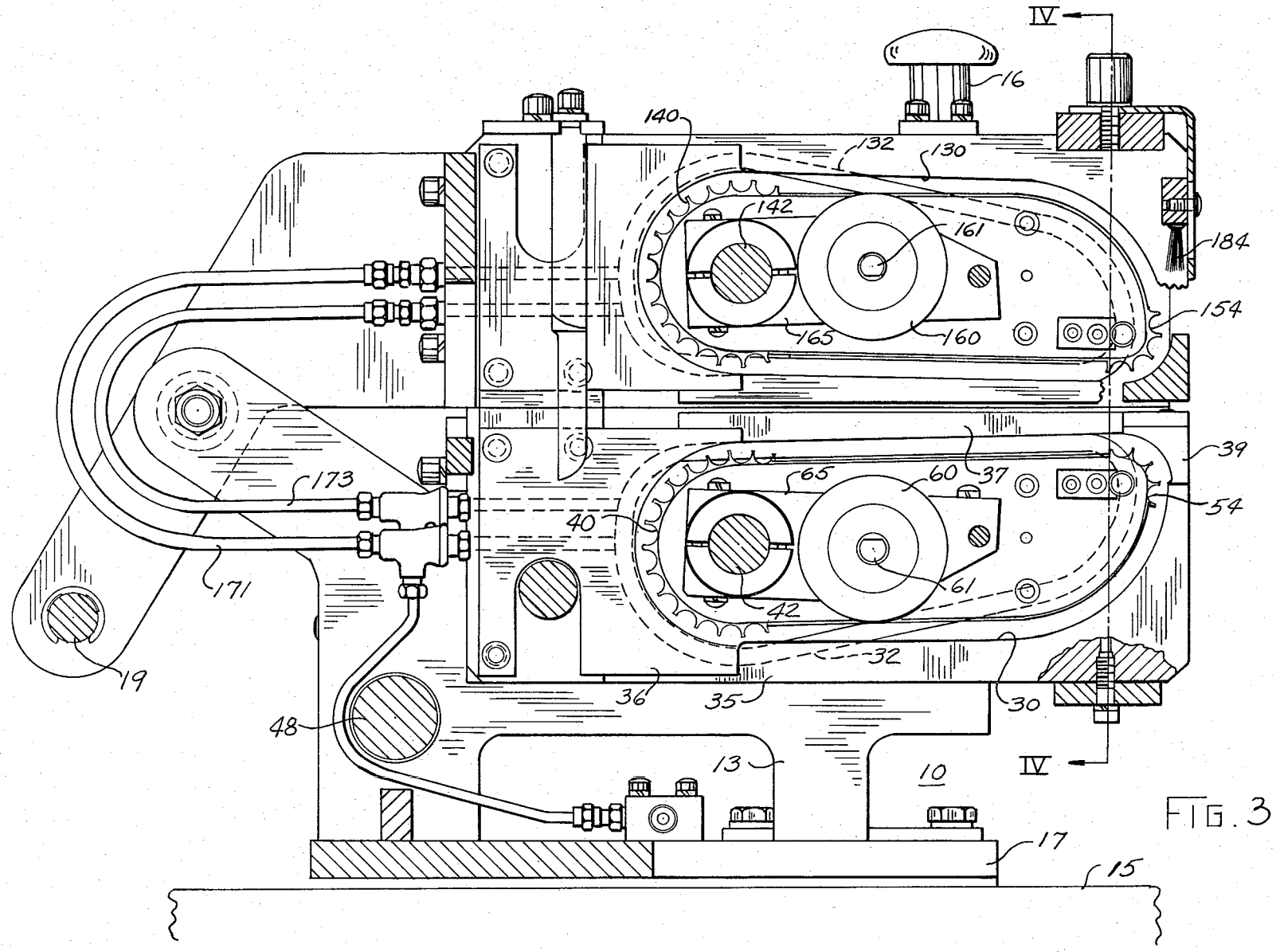
FIG. 3 is a section view of the apparatus of FIG. 2 (with the faller bars omitted for clarity) taken along the line III—III.
Figure 4:
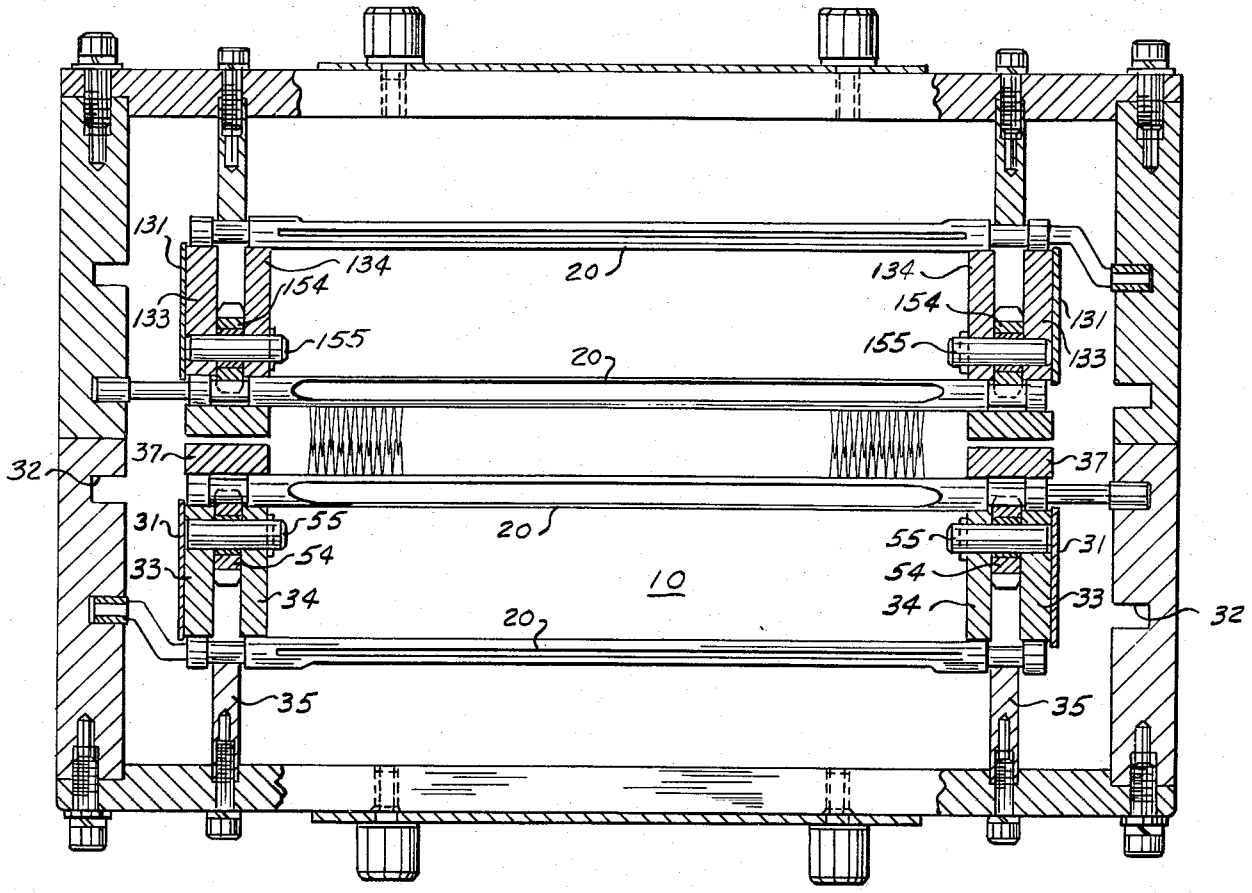
FIG. 4 is a partial section view of the gill box shown in FIG. 3 taken along the line IV—IV.
Figure 5:
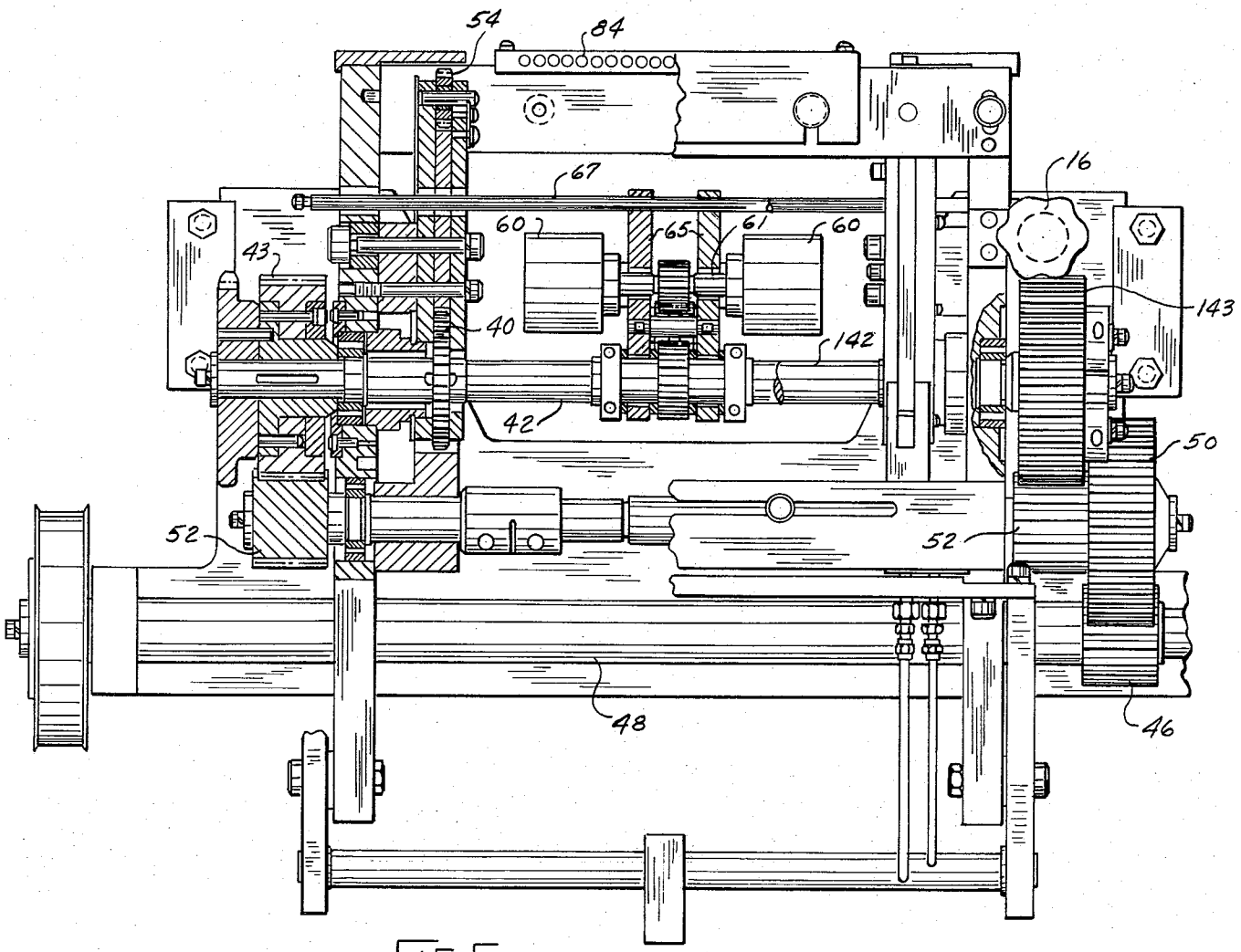
FIG. 5 is a top plan view of the gill box shown in FIG. 1 with portions removed and broken away for clarity.

Referring now to FIGS. 1 through 6, there is shown in detail a high speed gill box 10 constructed in accordance with the present invention. High speed gill box 10 comprises a lower head 12 and an upper head 14 held together by suitable fasteners 16. Heads 12 and 14 are connected together at one end by pivot joints 18. Thus, when fasteners 16 are disengaged upper head 14 can pivot away from lower head 12 around pivot connection 18 to open gill box 10. Lower head 12 is secured to a pedestal 13. Pedestal 13 is held to a machine base 15 by clamps 17. When clamps 17 secure pedestal 13 to base 15 and fasteners 16 are released, a force applied to connection 19 can pivot upper head 14 to an open position. When clamps 17 are loosened and fasteners 16 are secured, a force applied to connection 19 will shaft pedestal 13 relative to base 15. Lower head 12 contains a plurality of faller bars 20 (see FIG. 4) (not shown in FIGS. 2, 3, and 5 for clarity) which are confined to move in a closed path 30. Closed path 30 is formed from pairs of various structure members 33, 34, 35, 36, 37, and 39 as shown in FIGS. 3 and 4 to retain the ends of an elongated portion of faller bar 20.

Faller bar 20, as best seen in FIGS. 8 through 11, is formed with an elongated portion 22 with a plurality of aligned parallel pins 23 extending therefrom. Elongated portion 22 is not of uniform diameter, but has a portion machined away to provide for proper pin 23 clearance as bars 20 move around closed path 30. Cylindrical shaft portions 28, 29 extend from each end of elongated portion 22. Hardened journals 24 are formed on shafts 28, 29 outside of the pinned area and during operation support the elongated portion 22. The hardened journals 24 are restrained by the various structural members 33 through 37 and 39 to follow the closed path 30. Journals 24 support faller bar 20 to slide around closed path 30. A crank arm 26 extends from the free end of the cylindrical shaft portion 28 or 29. Half of the compliment of faller bars 20 in each head 12, 14 have crank arms 26 extending from shaft 29, as shown while the other half have crank arms 26 extending from shaft 28. These right hand and left hand faller bars 20 are alternately provided in the head 12, 14. Crank arm 26 has a free end portion which is parallel to the elongated portion 22. Crank arm 26 is unitarily movable with portion 22 and is used for controlling orientation of the drafting pins 23. When faller bars 20 are disposed in lower head 12, members 33, 34, 36, 37, and 39 engage the larger diameter portion of journals 24 while member 35 engages the smaller diameter portion of journals 24. A pair of flange plates 31 are provided to engage the ends of journals 24, to limit the sideway movement of faller bars 20 along their longitudinal axis. This prevents the faller bars from moving endwise as they slide around path 30. Lower head 12 also includes a pair of lower cam tracks 32 disposed outside of the lower guide path 30. Cam tracks 32 engage the outer end 27 of faller bar 20 to maintain proper orientation of the pin section. A nylon or oilite bronze roller 25 is provided on outer end 27 to facilitate movement along cam track 32. The outer edge of end 27, over which roller 25 is fit, is indented with a staking tool. This provides a slight protrusion 129 which holds roller 25 in place after it is forced onto end 27, and prevents it from dropping off during handling.

The construction and operation of upper head 14 is similar to the construction and operation of the lower head 12. Upper head 14 contains faller bar guide path 130 and a pair of cam tracks 132 which are a mirror image of the guide path 30 and the cam tracks 32 for the lower head 12. During operation faller bars 20 on opposite heads 12, 14 alternate entering drafting zone 41.

Figure 6:
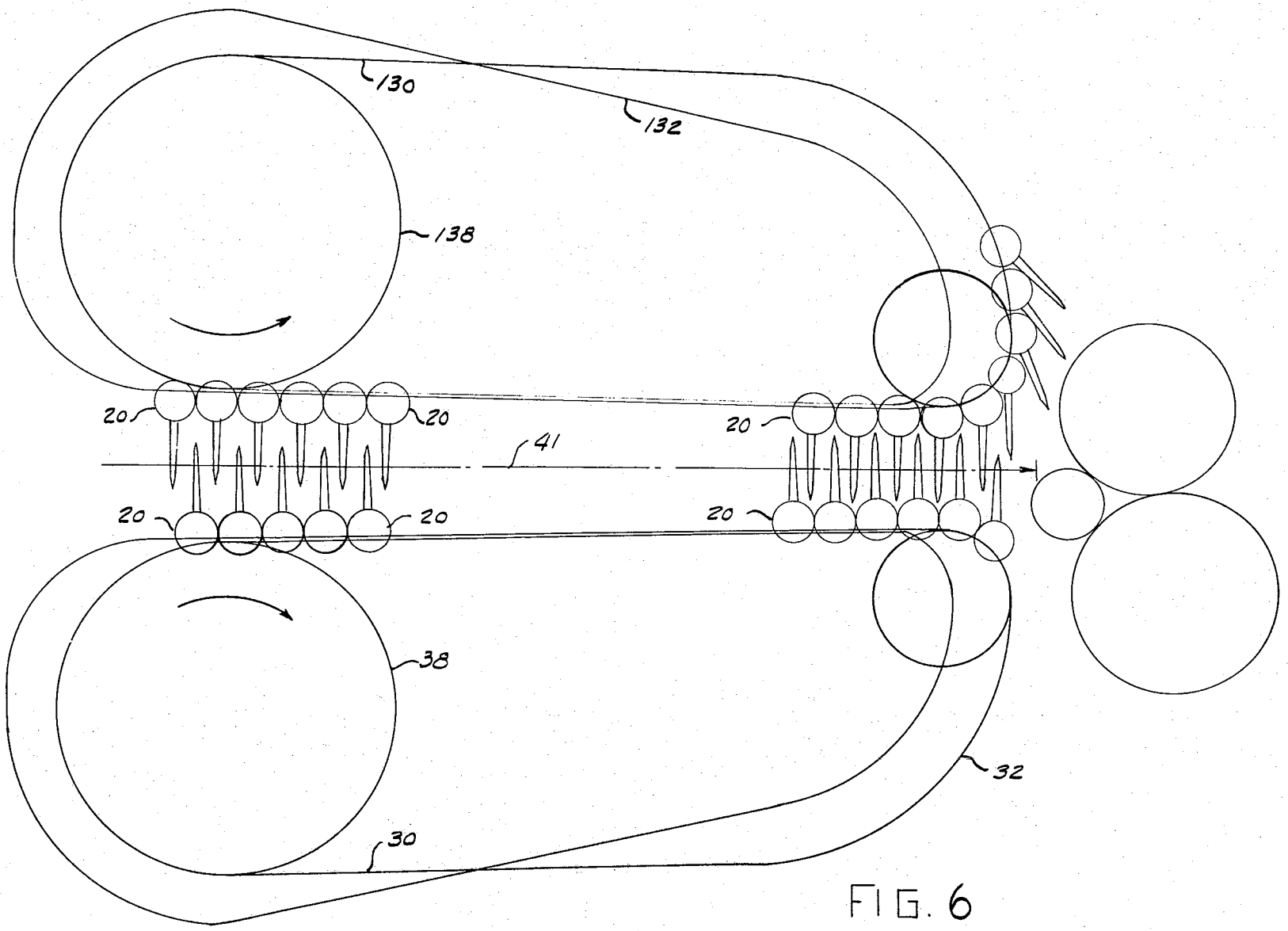
FIG. 6 is a schematic representation of the faller bar guide path and the cam track for apparatus according to the present invention.

Referring now to FIG. 6, there is shown a schematic representation of the faller bar guide paths 30, 130 and the cam tracks 32, 132 for the heads 12, 14 respectively. The faller bar paths 30, 130 approach and move essentially parallel to each other for a fixed distance to define drafting zone 41 through which textile sliver passes in the direction indicated by the arrowhead. Cam tracks 32, 132 engage crank arm 26 to maintain the faller bar pins 23 substantially perpendicular to the sliver in the drafting zone and to control the orientation of pins 23 at all other points along the faller bar paths 30, 130. As the faller bars move through the drafting zone 41 the pins 23 extending from faller bars on one head are disposed between the pins extending from a pair of adjacent faller bars on the opposite head. A set of nip rolls are disposed to grasp the textile sliver when it exits the drafting zone 41.

Faller bars 20 are individually disposed in paths 30, 130 and are not connected together. Drive means 38, 138 are provided at the beginning of drafting zone 41 to engage and move some of the faller bars 20 and thereby push the other bars along paths 30, 130. Drive means 38, 138 are connected together for simultaneous, synchronous movement.

Lower drive means 38 comprises a pair of sprockets 40 which are disposed to engage and move some of the faller bars 20. The hardened faller bar journals 24 which support faller bars 20 have a circular cross section. The sum of the diameters of all the journals 24 in path 30 is approximately equal to the length of path 30, so that each faller bar 20, through its journals 24, is in contact with the bar ahead of it. Thus, any motion imparted to one bar 20 results in motion to all the bars 20. The pair of sprockets 40 are mounted to a common shaft 42 which when rotated results in movement of faller bars 20 through their path 30. A similar arrangement is provided on upper head 14 wherein a pair of upper drive sprockets 140 are disposed on an upper sprocket shaft 142. Shafts 42 and 142 are interconnected by a pair of gears 43, 143 so that they move together. A main drive gear 46 is provided on a drive shaft 48. Drive gear 46 through gears 50 and 52 drives the lower sprocket drive gear 43 to operate the gill box 10. Drive sprockets 40 and 140 while being interconnected for synchronous movement are angularly offset to provide for the proper interlacing of pins 23 as they pass through the drafting zone 41.

A pair of lower idler sprockets 54 and a pair of upper idler sprockets 154 are provided at the end of the drafting zone for engaging the faller bars 20 as they move along paths 30, 130. Idler sprockets 54, 154 provide for a smooth transition of faller bars from the drafting zone 41. The drive sprockets 40, 140 and idler sprockets 54, 154 are disposed between plates 33, 133 and 34, 134 which define the inner periphery of paths 30, 130. Idler sprockets 54, 154 are supported on pins 55, 155 for free rotation. During operation the smaller diameter portion of journal 24 is engaged by drive sprockets 40, 140 and idler sprockets 54, 154.

The sum of all journal 24 diameters of the faller bars 20 in head 12 or 14 will be slightly less than the length of the faller bar paths 30, 130. Hence, a gap will develop between some bars in the faller bar path. If this gap should occur at the point where the faller bars 20 enter the drive sprockets 40, 140 a jam would result. A crowder roll 60, 160 is mounted in each head 12 or 14 to prevent this from occurring. Crowder rolls 60, 160 which are formed from a resilient material, bear against the faller bars 20 and rotate at a surface speed greater than the surface speed of the faller bars 20, hence, crowding the faller bars 20 together before they reach drive sprockets 40, 140. The surface speed of crowder rolls 60, 160 is approximately 25% faster than the surface speed of faller bars 20. This assures that each faller bar 20 enters sprocket 40, 140 smoothly. Crowder rolls 60, 160 are mounted on driven shafts 61, 161 to positively feed faller bars 20 to drive sprockets 40, 140. Crowder rolls 60, 160 are supported by pivotal plates 65, 165. Springs 66, 166 through rods 67, 167 bias crowder rolls 60, 160 into contact with faller bars 20.

Guides 80 are provided to guide sliver into gill box 10. Lubricating oil is metered from a manifold block through various connection and control apparatus 171, 173 to guide paths 30, 130 and cam tracks 32, 132. Brushes 84, 184 are provided to clean pins 23. Timing gears 86, 186 having the same number of teeth as drive sprockets 40, 140 are provided on shafts 42, 142. When heads 12 and 14 are closed, timing gears 86, 186 must mesh. When timing gears 86, 186 are meshed, the desired one half tooth off-set between drive sprockets 40, 140 is achieved. No re-timing is necessary when heads 12 and 14 are closed.

Figure 12:
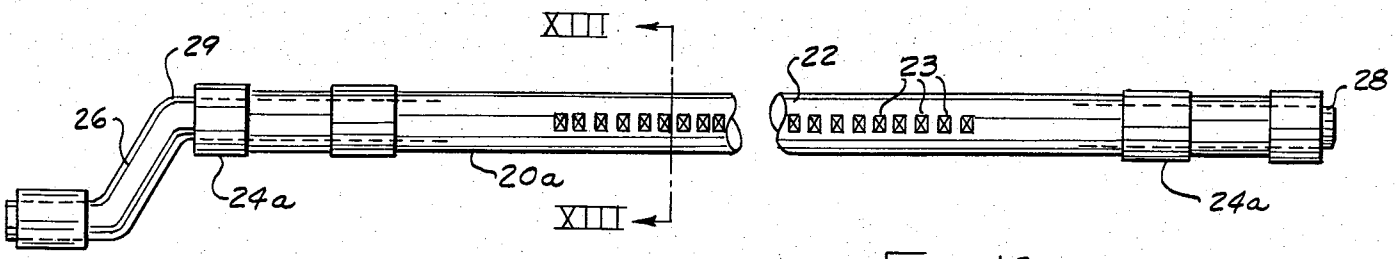
FIG. 12 is a view of another faller bar embodiment.
Figure 13:
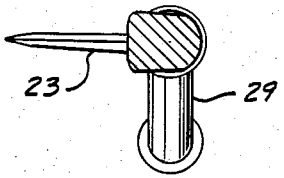
FIG. 13 is a section view of the faller bar of FIG. 12 along the line XIII—XIII.

Referring now to FIGS. 12 and 13, there is shown another embodiment of faller bar **20*a*. This embodiment may be a one-piece steel, except for pins 23, or composite plastic and sheet metal with pins integrally molded. In either case, the journals 24*a* are rotatably mounted. Crank arm 26 is formed, after mounting 24*a*, on 29 (as shown) or on 28 (alternately) forming left hand and right hand bars. Faller bar 20*a* is formed with an elongated portion 22 with a plurality of aligned parallel pins 23 extending therefrom. Cylindrical shaft portions 28, 29 extend from each end of elongated portion 22. Hardened rollers 24*a* are rotatably mounted on shafts 28, 29. The hardened rollers follow the closed path 30, 130 when the faller bar 20*a* is disposed in a head 12, 14**.

The speed of the disclosed gill box is greatly increased over prior art gill boxes. The disclosed gill box can operate faster than the textile equipment with which it is associated. For example, a typical speed for a prior art gill box is 1800 drops per minute while a gill box according to the invention can function at over 3000 drops per minute. The disclosed gill box 10 also is substantially quieter than those disclosed in the prior art. A prior art gill box could, for example, have a typical noise level of 94 dba while gill box 10 has a noise level measured under the same conditions of approximately 80 dba. The faller bars 20 are pushed around path 30, 130 in an uninterrupted flow. Gill box 10 provides smooth pin control with vertical insertion and withdrawal from the sliver.

We claim:

1. A high speed gill box having a drafting zone through which textile sliver is drawn comprising:

a plurality of faller bars each having a plurality of pins extending therefrom and an integral crank arm formed on one end thereof;

path means for constraining movement of said plurality of faller bars to a defined path along which the faller bars can move;

a drive sprocket disposed at one end of the drafting zone for engaging some of said plurality of faller bars and pushing others of said plurality of faller bars along the defined path;

an idler sprocket disposed at the opposite end of the drafting zone for assisting in guiding movement of the faller bars from the drafting zone;

cam track means for receiving the crank arm of said plurality of faller bars to control orientation of the faller bars as they are pushed along the path;

a crowder roll disposed to contact said faller bars moving along the defined path to urge them into engagement with said drive sprocket; and, wherein, the integral crank arm extends from one end only of each faller bar; and, the integral crank arm extends from opposite ends of adjacent faller bars constrained by said path means.

2. A high speed gill box as claimed in claim 1 comprising:

a second plurality of faller bars each having a plurality of pins extending therefrom and an integral crank arm formed on one end thereof;

a second path means for constraining movement of said second plurality of faller bars to a defined second path which mirrors movement of said first plurality of faller bars;

a second drive sprocket for engaging some of said second plurality of faller bars and pushing others of said second plurality of faller bars along the second path and being disposed at the front end of the drafting zone;

a second idler sprocket disposed at the opposite end of the drafting zone for assisting in guiding movement of said second plurality of faller bars from the drafting zone;

second cam track means for receiving the crank arms of said second plurality of faller bars to control orientation of the faller bars as they are pushed along the second path;

a second crowder roll disposed to engage some of said second plurality of faller bars as they move along the second path for forcing them into engagement with said second drive sprocket; and, said first plurality of faller bars and said second plurality of faller bars disposed so that their pins alternately enter the drafting zone.

3. A high speed gill box as claimed in claim 2 comprising:

interconnecting means for interconnecting said first drive sprocket and said second drive sprocket for simultaneous and synchronous movement; and wherein, said first drive sprocket and said second drive sprocket are angularly displaced so the pins of each of said first plurality of faller bars are disposed intermediate the pins of a pair of adjacent second plurality of faller bars as the faller bars travel through the drafting zone.

4. A gill box comprising:

a plurality of lower faller bars each having a plurality of drafting pins extending therefrom and a crank arm formed integral therewith;

means for defining a lower path along which said plurality of lower faller bars can travel;

lower drive means for driving said plurality of lower faller bars along the lower defined path by engaging some of said plurality of lower faller bars and pushing them along the defined path;

lower cam track means engaging the integral crank arms of said plurality of lower faller bars for controlling orientation of said lower faller bars;

an upper plurality of faller bars each having a plurality of drafting pins extending therefrom and a crank arm formed integral therewith;

means for defining an upper path along which said plurality of upper faller bars can travel;

upper drive means for driving said plurality of upper faller bars along the upper defined path by engaging some of the second plurality of faller bars and pushing them along the defined path;

upper cam track means engaging the integral crank arms of said upper faller bars for controlling orientation of said upper faller bars;

connecting means for connecting said upper drive means and said lower drive means for synchronous movement;

said upper drive means comprises a pair of upper drive sprockets disposed on a common shaft for engaging and driving some of said upper faller bars;

said lower drive means comprises a pair of lower drive sprockets for engaging and driving some of said lower faller bars;

said upper drive sprockets and said lower drive sprockets are angularly offset causing the drafting pins of each upper faller bar to extend intermediate the drafting pins of a pair of adjacent lower faller bars while passing through the drafting zone;

an upper crowder roll, which is driven, for engaging said upper plurality of faller bars and urging them into said upper drive sprocket as they move along the defined upper path; and, a lower crowder roll, which is driven, for engaging said lower plurality of faller bars and urging them into said lower drive sprocket as they move along the lower defined path.

5. A gill box as claimed in claim 4 wherein:

adjacent faller bars have the integral crank arms extending only from opposite ends.

6. A gill box draw frame comprising an upper head and a lower head each of which contains a plurality of faller bars constrained to move in a closed loop path wherein each faller bar comprises:

an elongated portion having pins extending from a central portion thereof;

a crank arm formed therewith and extending from said elongated portion for controlling orientation of the faller bars; and, wherein each head comprises:

a pair of guide tracks for constraining the associated faller bars to move in a closed path, one of said pair of guide tracks disposed on each end of the elongated portion of said faller bars;

drive means for driving said faller bars through the closed loop path;

a cam track disposed to engage the guide arm of said faller bar to maintain the desired orientation of said faller bars as they move through the closed loop path;

a drive sprocket for engaging some of said faller bars and forcing them into engagement with other faller bars to push the faller bars along the closed loop path;

an idler sprocket disposed in the cloed loop path to aid in guiding the faller bars; and, a driven crowder roll disposed for engaging the faller bars and urging them into the intake for the drive sprocket.

7. A gill box as claimed in claim 6 comprising:

interconnecting means for interconnecting the drive means for the upper head and the drive means for the lower head for simultaneous synchronous movement; and wherein, said drive sprocket for said upper head and said drive sprocket for said lower head are angularly offset so that during a portion of the faller bars travel along their closed loop paths the pins from the upper faller bars extend between the pins of a pair of adjacent faller bars on the lower head.

8. A gill box comprising an upper head, a lower head, fastening means for fastening said upper and lower head together to define a drafting zone therebetween, and wherein said upper head and said lower head each comprises:

a plurality of faller bars having an elongated portion with a plurality of parallel drafting pins extending therefrom and a crank arm extending from the elongated portion;

guides defining a closed path disposed to engage the elongated portion of said faller bars outside of the drafting pins to confine movement of the elongated portion around the closed path;

drive means for moving said plurality of faller bars around the closed path;

a cam track for engaging the crank arm extending from the elongated portion of each of said plurality of faller bars for maintaining a desired orientation of the faller bars as they move around the closed path;

said drive means comprises a pair of drive sprockets disposed near the entrance of the drafting zone for engaging and forcing faller bars through the drafting zone;

a pair of idler sprockets disposed near the exit from the drafting zone for engaging and aiding in guiding the faller bars from the drafting zone; and, a crowder roll for engaging the faller bars as they move around the closed path and for forcing them into the pair of drive sprockets.

9. A gill box as claimed in claim 8 wherein:

said pair of drive sprockets for the upper head and said pair of drive sprockets for the lower head are connected together by appropriate gearing to provide for simultaneous and synchronous movement.

10. A gill box as claimed in claim 9 wherein:

the crank arms extend from opposite ends of adjacent faller bars in said upper head and said lower head.

11. A gill box as claimed in claim 10 wherein:

said cam tracks for the upper head and lower head maintain the drafting pins parallel while in the drafting zone.

* * * * *